US010112386B2

(12) United States Patent
Garcia Alvarez et al.

(10) Patent No.: US 10,112,386 B2
(45) Date of Patent: Oct. 30, 2018

(54) NON-UNIFORM SPITTING

(71) Applicant: HEWLETT-PACKARD DEVELOPMENT COMPANY, L.P., Houston, TX (US)

(72) Inventors: Ana Cristina Garcia Alvarez, Sant Cugat del Valles (ES); Marta Coma Vives, Barcelona (ES); Mauricio Seras Franzoso, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/327,954

(22) PCT Filed: Jul. 30, 2014

(86) PCT No.: PCT/US2014/048790

§ 371 (c)(1),
(2) Date: Jan. 20, 2017

(87) PCT Pub. No.: WO2016/018277

PCT Pub. Date: Feb. 4, 2016

(65) Prior Publication Data

US 2017/0210125 A1 Jul. 27, 2017

(51) Int. Cl.
*B41J 2/045* (2006.01)
*B41J 2/165* (2006.01)

(52) U.S. Cl.
CPC ..... *B41J 2/04536* (2013.01); *B41J 2/04586* (2013.01); *B41J 2/16526* (2013.01); *B41J 2002/1657* (2013.01)

(58) Field of Classification Search
CPC .... B41J 2/04536; B41J 2/04586; B41J 2/045; B41J 2/16517; B41J 2/1721; B41J 2/185; B41J 2/19
See application file for complete search history.

(56) References Cited

U.S. PATENT DOCUMENTS 5,469,199 A * 11/1995 Allen ..... B41J 2/14024 347/42
5,659,342 A 8/1997 Lund et al.
6,293,645 B1 9/2001 Kim
6,616,266 B2 * 9/2003 Neal ..... B41J 2/16508 347/23
8,287,066 B2 * 10/2012 Jackson ..... B41J 29/393 347/19
2002/0171699 A1 11/2002 Choi
(Continued)

FOREIGN PATENT DOCUMENTS

JP 2005349798 12/2005

OTHER PUBLICATIONS

Tsai, Chen-Chu, et al. "Test Pattern and Drop Tracing for Nozzle Healthy Diagnostic." NIP & Digital Fabrication Conference. vol. 2006. No. 1. Society for Imaging Science and Technology. Jan. 1, 2006.

(Continued)

*Primary Examiner* — Thinh H Nguyen
(74) *Attorney, Agent, or Firm* — HP Inc. Patent Department

(57) ABSTRACT

A printer is disclosed. The printer spits printing fluid from nozzles using a spit pattern. The spit pattern is non-uniform along the spit pattern length.

18 Claims, 8 Drawing Sheets

(56) References Cited

U.S. PATENT DOCUMENTS

| | | | |
|---|---|---|---|
| 2006/0132527 | A1 | 6/2006 | Cordery et al. |
| 2009/0225115 | A1 | 9/2009 | De Wall |
| 2013/0187973 | A1 | 7/2013 | De Smet et al. |
| 2014/0176628 | A1 | 6/2014 | Anderson et al. |
| 2014/0176633 | A1 | 6/2014 | Gerrits |

OTHER PUBLICATIONS

Korean Intellectual Property Office, International Search Report and Written Opinion for PCT/US2014/048790 dated Apr. 9, 2015 (13 pages).

* cited by examiner

NON-UNIFORM SPITTING

BACKGROUND

Inkjet printers are printers that eject printing fluids onto media from a plurality of nozzles on one or more printheads. The printheads can be thermal ink printhead, piezo electric printhead or the like. Printing fluid is any fluid deposited onto media to create an image, for example a pre-conditioner, gloss, a curing agent, colored inks, grey ink, black ink, metallic ink, optimizers and the like. Inkjet inks can be water based inks, latex inks or the like.

Inkjet printers are printers that traditionally sweep a carriage back and forth across the media as printheads mounted in the carriage deposit printing fluids onto the media. The media is advanced after each swath of the image is printed onto the media. After all the swaths are printed the media is ejected from the printer.

DETAILED DESCRIPTION

Figure 1:
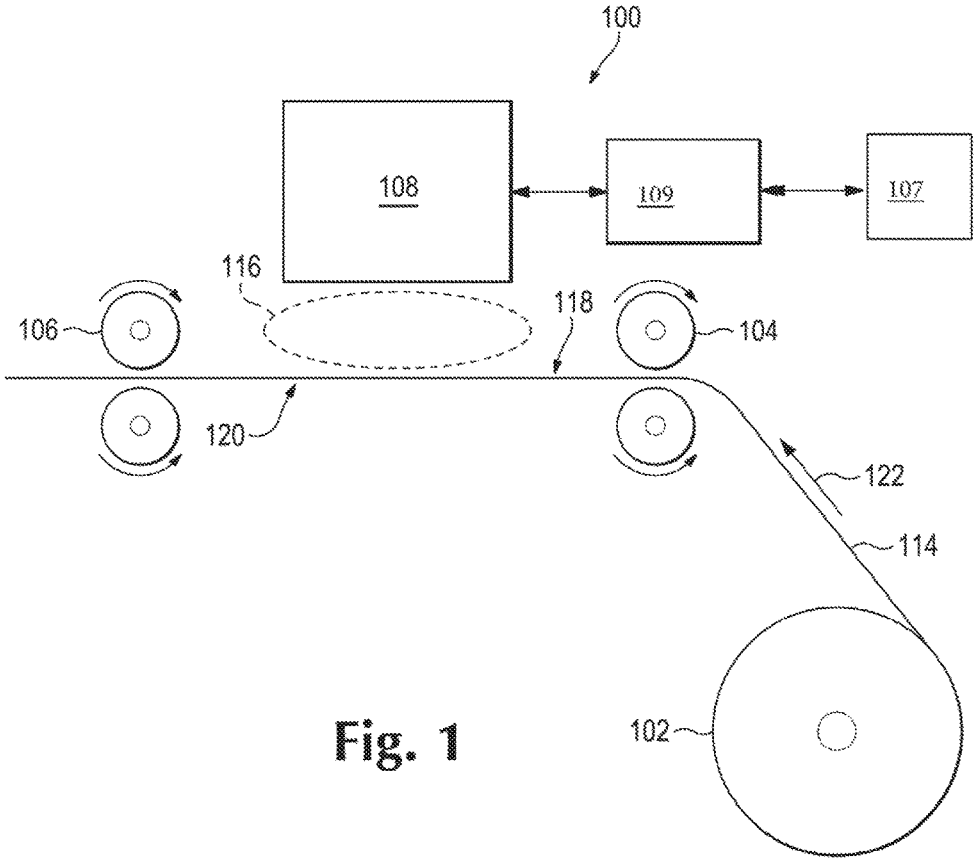
FIG. 1 is a side view of an example printer 100.

Inkjet printers form images by ejecting or spitting printing fluids from nozzles on a printhead onto media. In this application the process of ejecting printing fluid from a nozzle may be known as spitting, ejecting, depositing or the like. Printing fluid is any fluid deposited onto media to create an image, for example a pre-conditioner, gloss, a curing agent, colored inks, grey ink, black ink, metallic ink, optimizers and the like. Inkjet inks can be water based inks, latex inks or the like.

When a nozzle becomes inoperative, the nozzle no longer spits printing fluid onto the media. There are a number of different conditions that can cause a nozzle to become inoperative, for example the nozzle can become clogged with material, for example ink, dried out, worn out or the like. When one or more nozzles become inoperative it can cause image defects. Some types of printing fluids can cause nozzles to become inoperative more often or more quickly than other types of printing fluids, for example latex based inks.

One way of preventing a nozzle from becoming inoperative or repairing a nozzle that has become inoperative is to pre-condition the nozzle before printing a user image. During a pre-conditioning process each nozzle in a printhead spits a pre-determined number of drops. The number of drops for each nozzle is determined by a spit pattern. The spit pattern is typically stored in memory and is retrieved during the pre-conditioning process to determine the number of drops to spit from each nozzle.

Current spit patterns cover a small portion of the printhead, for example a 36 nozzle long pattern. A typical printhead may have 1056 nozzles. The small spit pattern is replicated along its length until the all the nozzles in a printhead are covered. This produces a uniform number of drops for each nozzle in the printhead. Unfortunately, some nozzles may need to spit more drops than other nozzles before full functionality of the nozzle is reached.

In one example, a spit pattern stored in memory will be large enough to cover all the nozzles in a printhead. The spit pattern will be non-uniform along its length. This will cause the nozzles along the length of the printhead to spit non-uniformly during the pre-conditioning process. The spit pattern may be non-uniform in the number of drops spit by each nozzle and/or may be non-uniform in the frequency that the drops are spit by the different nozzles. The non-uniform spit pattern will cause some nozzles in the printhead to spit more drops than other nozzles and/or spit drops at a faster rate than other nozzles during the pre-conditioning process.

Pre-conditioning typically takes place just prior to when a pass is made when printing a user image. A pass occurs each time the carriage/printheads travels across the width of the page while depositing printing fluids. Some print modes use multiple passes across the same part or swath of media. Some print modes deposit all the printing fluid for a swath in a single pass of the printheads across the width of the media. In some multi-pass print modes the printheads deposit printing fluid when traveling only in one direction. In these modes the printheads do not deposit printing fluids when the printheads are retracted back across the width of the media. In other print modes the printheads deposit printing fluids while traveling in both directions across the width of the media.

In one example, the nozzles in as printhead will be pre-conditioned by spitting the nozzles using a spit pattern. The spit pattern will be loaded from memory and has a length that matches the number of the nozzles in a trench. The spit pattern will be non-uniform along the length of the spit pattern. In some examples the spit pattern will spit each nozzle in the trench at least once. In other examples the spit pattern may not spit some of the nozzles in the trench.

A trench may comprise one or more rows of nozzles. In one example a trench will contain a single row of nozzles. In another example a trench will contain two rows of nozzles adjacent to each other, with each row of nozzles having the same nozzle to nozzle spacing. The two rows of nozzles will be offset with one another by ½ the nozzle to nozzle spacing along the length of the nozzles to produce a trench that can print drops at twice the nozzle to nozzle spacing. For example a trench may have two rows of nozzles with each row having 600 nozzles per inch. The two rows of nozzles are offset with respect to each other by $1/1200$ of an inch along the length of the rows of nozzles. This allows the trench to deposit 1200 drop of printing fluid per inch.

FIG. 1 is a side view of an example printer 100. Printer 100 comprises a media source 102, a pair of pinch rollers 104, a pair of take-up rollers 106, a print engine 108, a controller 109, a memory 107 and media 114. A media path runs from the media source 102, between the pair of pinch rollers 104, underneath the print engine 108 and between the pair of take-up rollers 106. Media 114 is shown in the media path. During printing the media 114 travels along its length in a printing direction as shown by arrow 122.

A print zone 116 is underneath the print engine 108. The print zone is defined as the location where printing fluid from the print engine is deposited onto the media 114. Printing fluid is any liquid that is deposited by the print engine and can comprise black ink, colored inks, gloss, pre-treatment fluids, finishing fluids, optimizers and the like. In one example the print engine comprises a mounting system for at least one printhead. The printhead deposit printing fluid through nozzles onto the media.

Printer 100 is shown with media fed from a roll. In other examples the printer may have sheets of media fed from an input tray. In yet another example, the printer may be a 3D printer and the media may be a support platform on which a layer of a powdered build material has been funned. Media 114 has a first side 118 and a second side 120. The first side 118 of the media is facing the print engine 108.

Controller controls the printer. In one example the controller pre-conditions the nozzles in each printhead in the print engine 108 before printing a user image (as discussed in more detail below). The controller pre-conditions the nozzles by loading a spit pattern from memory and spitting the nozzles using the spit pattern.

Figure 2:
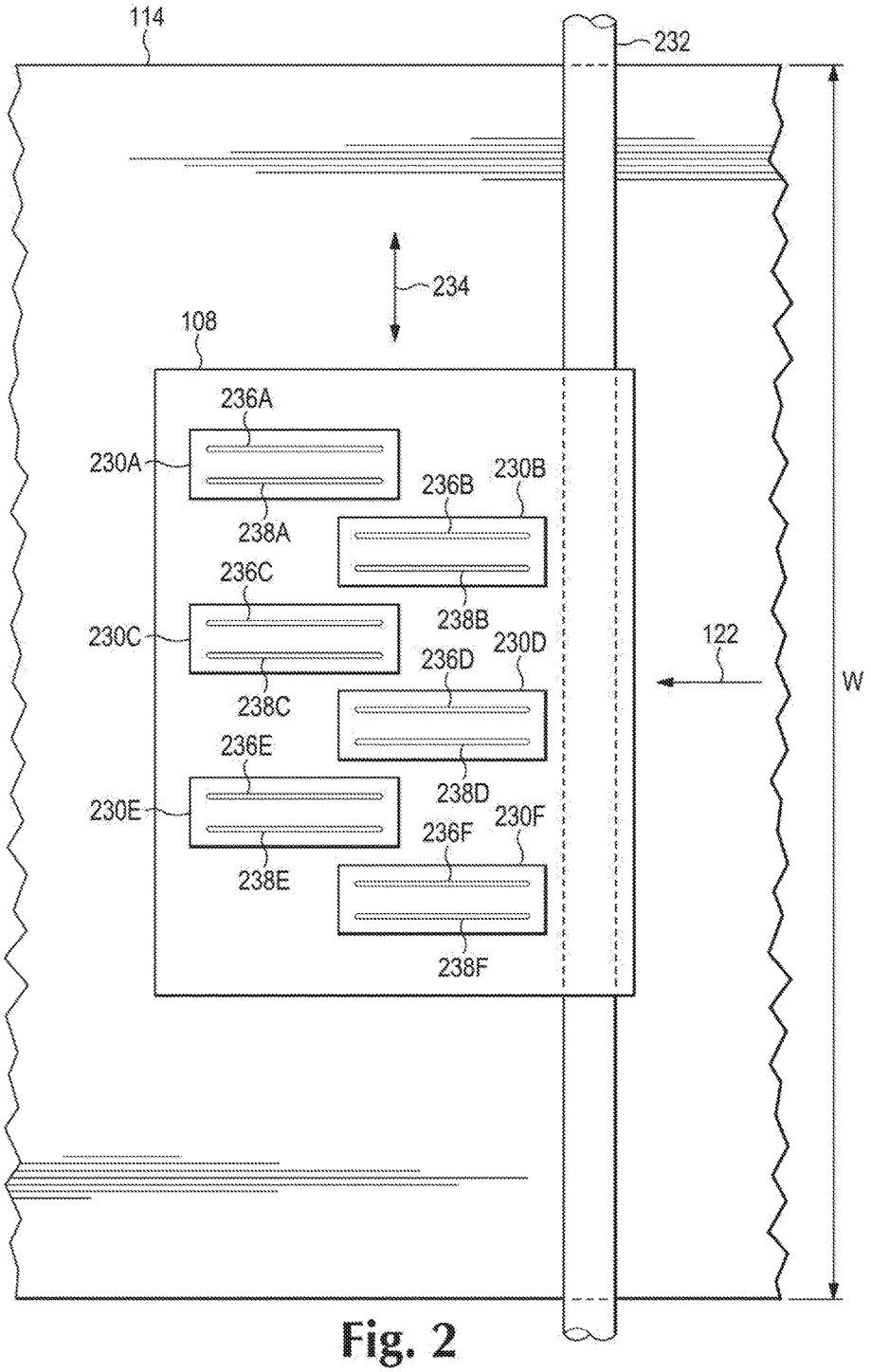
FIG. 2 is a sectional top view of the example printer 100.

FIG. 2 is a sectional top view of the example printer 100. In this example print engine 108 is configured as a carriage mounted on guide rail 232. The carriage travels back and forth across the width W of the media 114 along a scan axis as shown by arrow 234. In some examples the width of the media may be between 60 and 180 inches wide (1524 to 4572 mm wide), for example 130 inches (3,302 mm) wide. In other examples the width of the media may be smaller or larger. The print engine 108 may also comprise motors, drive belts or gears, additional guide rails, linear or angular position sensors and the like, but these items are not shown for clarity. The carriage comprises a mounting system for at least one printhead.

Printheads (230 A-F) mounted in the carriage deposit printing fluids onto the first side 118 (see FIG. 1) of media 114 as the carriage travels across the width of the media 114. In this example 6 printheads (230 A-F) are shown mounted in the carriage. The carriage has a mounting system that allows the printheads (230 A-F) to be removably mounted onto the print engine. The printheads (230 A-F) are typically user loadable/replaceable. In some examples, the printheads may be shipped to the end user in a separate package than the printer.

In this example, each printhead has two trenches of nozzles. Each printhead may deposit the same printing fluid out of both trenches or may deposit a different printing fluid out of each trench. For example printhead 230B may deposit cyan ink out of trench 236B and black ink out of trench 238B. In one example the printer may use a 6 color ink system, for example cyan ink, yellow ink, magenta ink, light magenta ink, light cyan ink and black ink (C, Y, M, LM, LC, K). In addition to inks a printhead may be used to print additional printing fluids, for example an optimizer. In other examples the printer may use a higher or lower number of ink colors, for example 4 different ink color. In other examples there may be more or fewer printheads mounted in the carriage. When printing an image the media 114 is advanced in the printing direction 122 after each swath of the image is printed.

In one example, printheads (230 A-F) will be pre-conditioned before each pass of a user image. The pre-conditioning process will spit the nozzles in each printhead mounted in the carriage. The nozzles will be spit according to a spit pattern. In one example the printer may only print while the carriage is traveling in one direction. In this case the nozzles will be located off to only one side of the media during the pre-conditioning process. In another example the printer may print while the carriage is traveling in both directions across the width of the media. In this case the printheads may be located on either side of the media during the pre-conditioning process.

Figure 3:
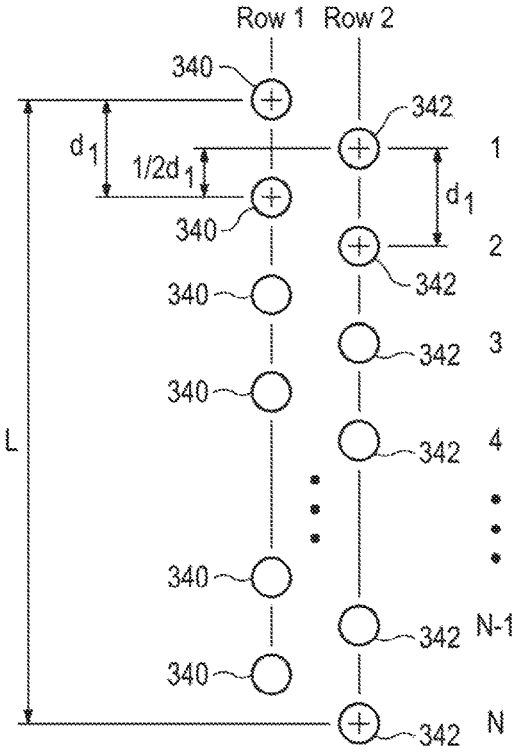
FIG. 3 is a magnified view of an example trench.

FIG. 3 is a magnified view of an example trench. In this example the trench has two rows of nozzles, row 1 and row 2. Each row of nozzles has N nozzles, for a total number of nozzles in the trench of 2N. Each row of nozzles has the same nozzles to nozzle spacing d1. The nozzles 340 in row 1 are offset along the row length from the nozzles 342 in row 2 by ½ the nozzle to nozzle spacing (i.e. ½ d1). The total length of the trench is L. A spit pattern for the trench of FIG. 3 has the same number of entries as the number of nozzles in the trench (i.e. 2N).

Figure 4A:
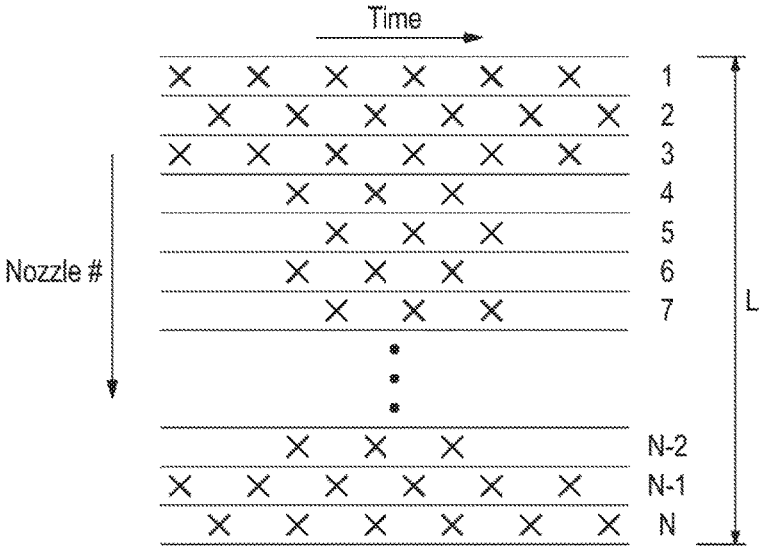
FIG. 4A is an example spit pattern.

FIG. 4A is an example spit pattern. The spit pattern has N rows along the spit pattern length L. Each row in the spit pattern corresponds to a nozzle in a trench. An X in the spit pattern along the width of the spit pattern corresponds to the time the nozzle in that row will be spit. The number of Xs in a row correspond to the number of times the nozzle in that row will be spit during the pre-conditioning process. For example nozzle number 3 in a trench will be spit 6 times during a pre-conditioning process when this spit pattern is used. The spacing between the Xs along the width of the spit pattern determines the spit rate or firing frequency of the nozzle corresponding to that row. The spit pattern is non-uniform along its length, for example nozzle 1 will be spit more often than nozzle 6 when using this spit pattern. In this example the spit pattern is non-uniform in the number of times a nozzle will spit.

Some printers can print on porous media. Porous media is media that allows some of the printing fluid to pass through the media during printing, for example textiles. The printing fluid that passes through the porous media is collected by a gutter that runs along the width of the media. In some printers the gutter is not as high as the trenches on a printhead. Therefore when printing on porous media, all the nozzles on the printhead are not used. The nozzles that are not used while printing the user image need to be spit more that the nozzles that are used to print the user image during the pre-conditioning process.

Figure 4C:
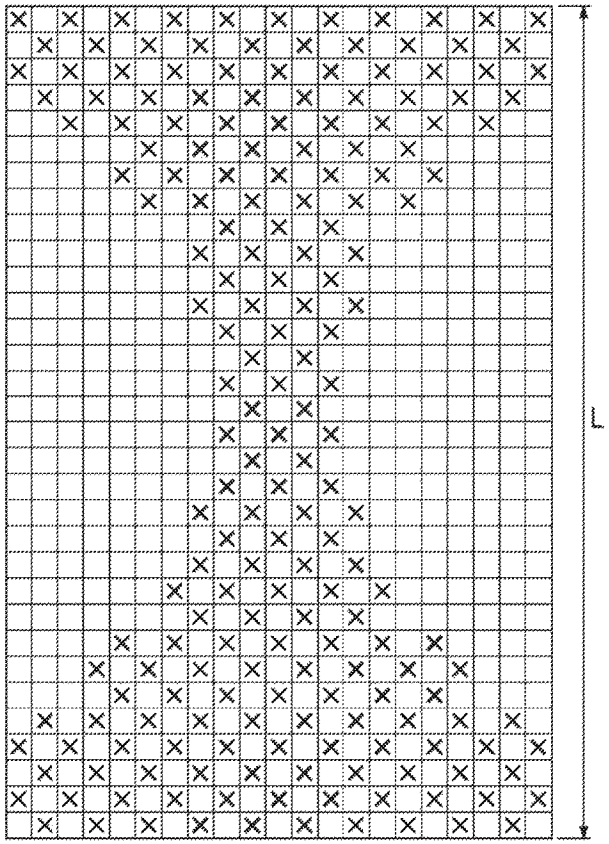
FIG. 4C is an example spit pattern.
Figure 4B:
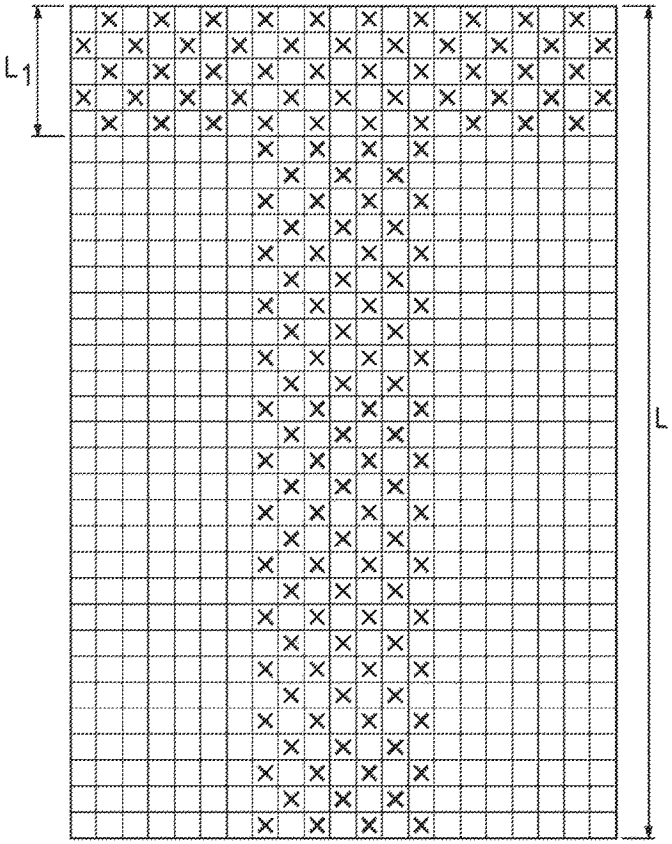
FIG. 4B is an example spit pattern.
Figure 4E:
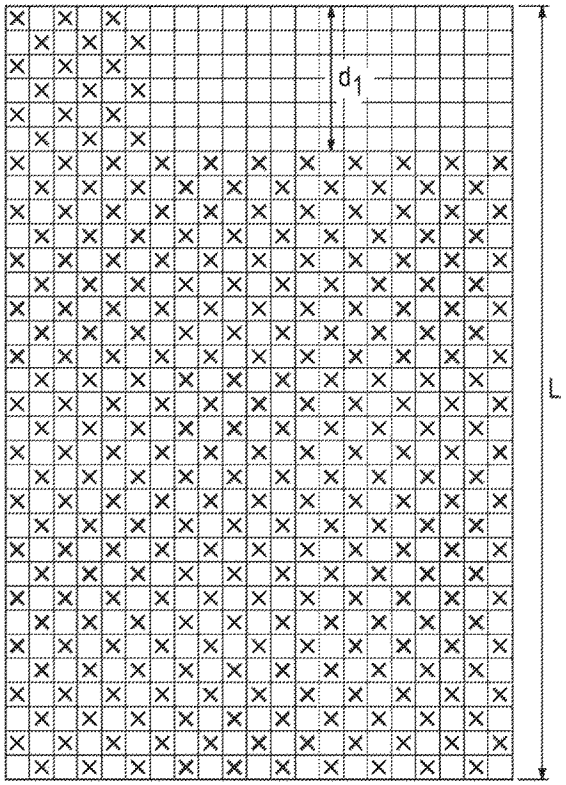
FIGS. 4E, 4F, 4G and 4H are example spit patterns for a multi-pass print mode.

FIG. 4B is another example spit pattern. The spit pattern has a length L corresponding to the length of a trench on a printhead. In this example one end of the pattern (length L1) has a higher number of spits per nozzle than the rest of the spit pattern. This type of spit pattern may be used during the pre-conditioning process when printing on porous media. The length L1 corresponds to the nozzles that are outside of the area covered by the gutter.

FIG. 4C is another example spit pattern. This spit pattern has gradually more spits per nozzle towards each end of the spit pattern, with the fewest number of spits per nozzle in the middle of the spit pattern. This type of spit pattern may be used when heat is applied to the media before and after printing a swath. For example the media may be pre-heated before the swath is printed and the ink may be dried after printing a swath. The heat will affect each end of the printhead/trench more than it will affect the middle of the printhead/trench. Therefore the nozzles on each end may require more spits to restore the nozzle to full functionality during the pre-conditioning process.

Figure 4D:
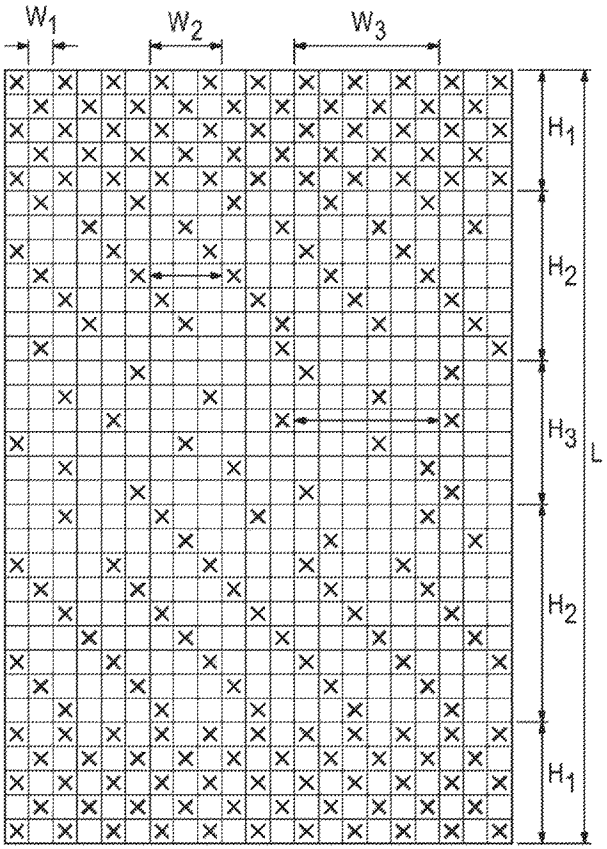
FIG. 4D is an example spit pattern.
Figure 4G:
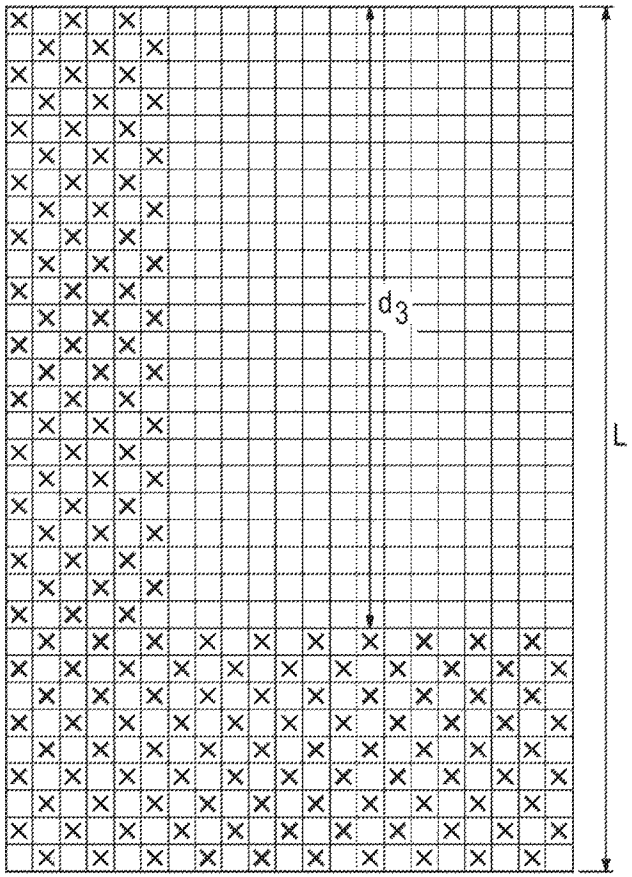
Figure 4F:
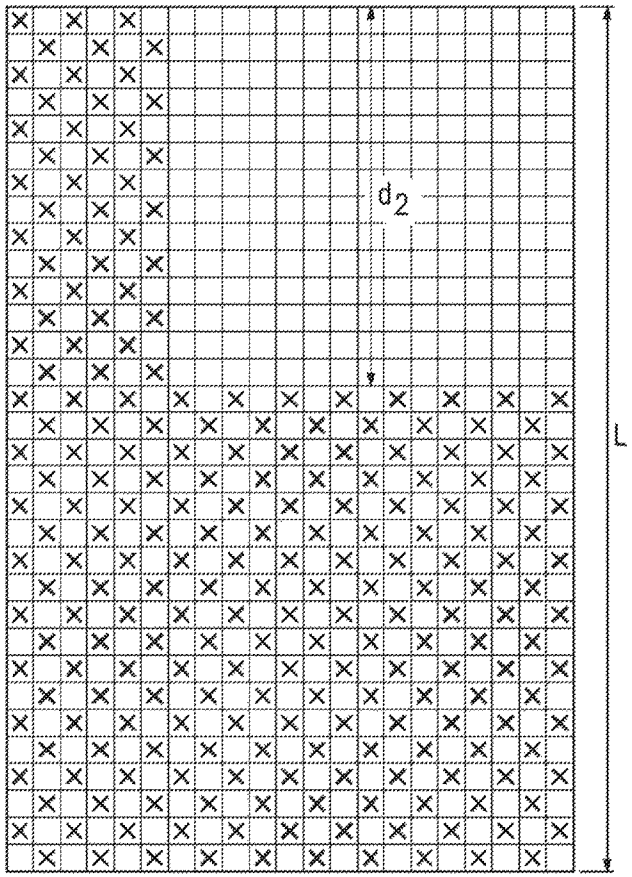
Figure 4H:
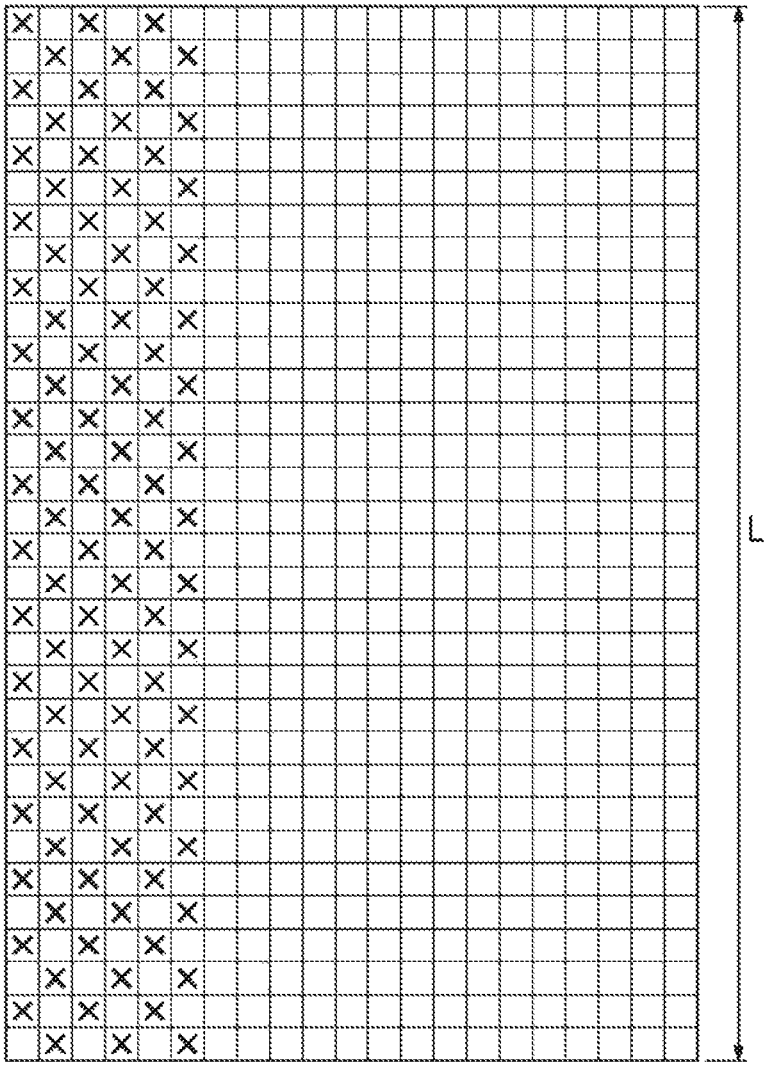

FIG. 4D is another example spit pattern. This spit pattern is non-uniform in the spit rate for nozzles along the length of the spit pattern/trench. The spacing between the Xs determines when a nozzle is spit. In a first section H1 of the spit pattern (on each end of the pattern) there is one space W1 between each X on a row. In a second section H2 of the spit pattern (on either side of the middle section) there is three spaces W2 between each X on a row. Therefore the nozzles in section H1 will spit three times more frequently than the nozzles in section H2. In a third section H3 of the spit pattern (in the middle) there is six spaces W3 between each X on a row. The time between spits for nozzles in this section is six times longer than for nozzles in sections H1.

In some examples a printer may use a number of different print modes. The different print modes may use a different number of passes with some print modes using only 1 pass and other print modes using up to 16 passes. FIGS. 4E, 4F, 4G and 4H are example spit patterns for a multi-pass print mode. In this example the print mode uses 4 passes. Spit pattern 4E may be used after the first pass, spit pattern 4F may be used after the second pass, spit pattern 4G may be used after the third pass and spit pattern 4H may be used after the fourth and last pass.

In some 4 pass print modes, the number of nozzles used increase for each pass. For example, in the first pass only the nozzles that correspond to distance d1 (in spit pattern 4E) may be used. Therefore the nozzles along the rest of the length of the trench may need to be spit more than the nozzles in area d1 during the pre-conditioning process before the next pass is printed. In the second pass only the nozzles that correspond to distance d2 (in spit pattern 4F) may be used.

In some examples, printheads may use different spit patterns dependent on the type of printing fluid being deposited. For example, a printhead that deposits black ink may use a spit pattern that has a higher number of spits per nozzle compared to a printhead that deposits cyan ink. With some ink formulations, for example latex inks, black ink and yellow ink may require more spits per nozzle than other colors to maintain the heath of the nozzles. In other ink formulations, other colors of ink may require more spits per nozzle to maintain the heath of the nozzles.

Figure 5:
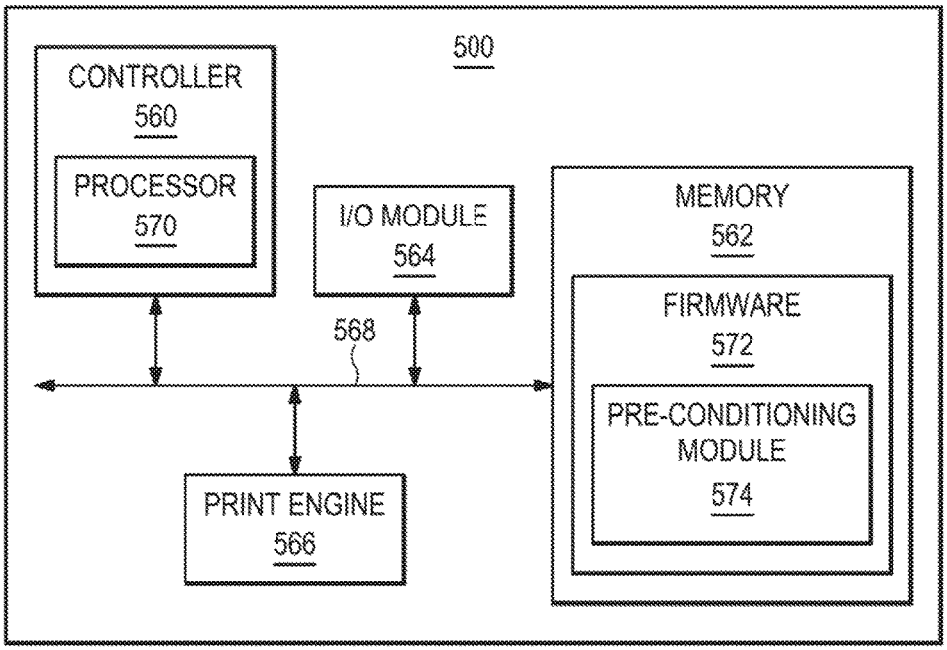
FIG. 5 is an electrical block diagram of an example printer control system 500.

FIG. 5 is an electrical block diagram of an example printer 500. Printer comprises a controller 560, memory 562, input/output (I/O) module 564 and a print engine 566 all coupled together on bus 568. In one example the controller may be the controller in the printer shown in FIG. 1. In some examples printer may also have a user interface module, an input device, and the like, but these objects are not shown for clarity. Controller 560 comprises at least one processor 570. The processor 570 may comprise a central processing unit (CPU), a micro-processor, an application specific integrated circuit (ASIC), or a combination of these devices.

Memory 562 may comprise volatile memory, non-volatile memory, and a storage device. In one example the memory may be the memory in the printer shown in FIG. 1. Memory 562 is a non-transitory computer readable medium. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM). Examples of storage devices include, but are not limited to, hard disk drives, compact disc drives, digital versatile disc drives, optical drives, and flash memory devices.

I/O module 564 is used to couple printer to other devices, for example the Internet or a computer. Printer has computer executable code, typically called firmware 572, stored in the memory. The firmware 572 is stored as computer readable instructions in the non-transitory computer readable medium (i.e. the memory 562). The processor generally retrieves and executes the instructions stored in the non-transitory computer-readable medium to operate the printer and to execute functions. In one example, processor executes code that pre-conditions the printhead by spitting drops from the nozzles on the printhead.

Firmware 572 contains a pre-conditioning module 574. The processor executes the code in the pre-conditioning module 574 to spit drops from a printhead. In one example the pre-conditioning module 574 may store a plurality of spit patterns, for example between 5 and 30 spit patterns. The pre-conditioning module may use the method shown in FIG. 6 to spit drops from a printhead.

Figure 6:
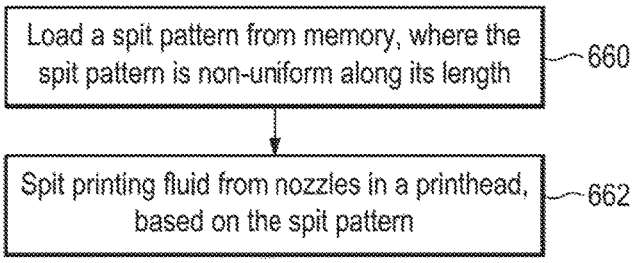
FIG. 6 is an example flow chart for pre-conditioning a printhead.

FIG. 6 is an example flow chart for pre-conditioning a printhead. At block 660 a spit pattern is loaded from memory, wherein the spit pattern is non-uniform along its length. At block 662 the printing fluid is spit from a plurality of nozzles in a trench before printing a pass of a user image, wherein the printing fluid is spit based on the spit pattern. In some examples the spit pattern will spit each nozzle in the printhead at least once. In other examples the spit pattern may not spit some of the nozzles in the printhead.

What is claimed is:

1. A printer, comprising:

a mounting system for a printhead having nozzles formed in a trench;

a memory to store different spit patterns for respective different types of printing fluid, wherein each respective spit pattern of the different spit patterns is non-uniform along a length that is based on a number of the nozzles of the trench; and a controller to:

during pre-conditioning of the printhead:

select a spit pattern from among the different spit patterns stored in the memory dependent upon a type of the printing fluid used to form a user image, the selected spit pattern being a first spit pattern of the different spit patterns responsive to a first type of the printing fluid being used to form the user image, and the selected spit pattern being a different second spit pattern of the different spit patterns responsive to a different second type of the printing fluid being used to form the user image, cause spitting of the printing fluid from the nozzles according to the selected spit pattern loaded from the memory while the nozzles of the printhead are off to one side of a media, before printing a pass of the user image onto the media, wherein the selected spit pattern is separate from the user image; and after the pre-conditioning of the printhead, cause printing of the pass of the user image onto the media when the nozzles of the printhead are over the media.

2. The printer of claim 1, wherein each of the non-uniform spit patterns causes one of the plurality of nozzle to spit at a different frequency than another one of the plurality of nozzles when the printhead is pre-conditioned.

3. The printer of claim 1, wherein each of the non-uniform spit patterns causes one of the plurality of nozzles to spit more times than another one of the plurality of nozzles when the printhead is pre-conditioned.

4. The printer of claim 1, wherein the mounting system is to mount a plurality of printheads, and the memory is to store a plurality of spit patterns for respective printheads of the plurality of printheads, the controller to use:

one of the plurality of spit patterns for a first printhead loaded in the mounting system, and a different one of the plurality of spit patterns for a second printhead loaded in the mounting system.

5. The printer of claim 1, wherein the controller is to use:

one spit pattern for a first pass of a multi-pass print mode, and a different spit pattern for a second pass of the multi-pass print mode.

6. The printer of claim 1, wherein the first and second types of printing fluid comprise an ink with a first color and an ink with a second color, the controller to use:

the first spit pattern for the ink with the first color, and the second spit pattern for the ink with the first color.

7. The printer of claim 1, wherein the spitting of the printing fluid from the nozzles is performed during the pre-conditioning operation that is separate from any printing operation that prints a pass of the user image.

8. The printer of claim 1, wherein the length of the spit pattern matches the number of the nozzles in the trench.

9. The printer of claim 1, wherein each of the different spit patterns has a same number of entries as the number of the nozzles in the trench.

10. A method of controlling printing by a controller, comprising:

during pre-conditioning of a printhead:

selecting a spit pattern from among different spit patterns stored in a memory dependent upon a type of printing fluid used to form a user image, the selected spit pattern being a first spit pattern of the different spit patterns responsive to a first type of the printing fluid being used to form the user image, and the selected spit pattern being a different second spit pattern of the different spit patterns responsive to a different second type of the printing fluid being used to form the user image, wherein each respective spit pattern of the different spit patterns is non-uniform along a length of the respective spit pattern;

causing spitting of the printing fluid from a plurality of nozzles in a trench of the printhead according to the selected spit pattern loaded from the memory while the plurality of nozzles are off to one side of a media before printing a pass of the user image onto the media, wherein the selected spit pattern is separate from the user image; and after the pre-conditioning of the printhead, causing printing of the pass of the user image onto the media when the plurality of nozzles of the printhead are over the media.

11. The method of claim 10, wherein each respective spit pattern of the different spit patterns is non-uniform along the length of the respective spit pattern in a frequency domain.

12. The method of claim 10, wherein each respective spit pattern of the different spit patterns is non-uniform along the length of the respective spit pattern in numbers of drops spit by respective different nozzles.

13. The method of claim 10, wherein the pass is a given pass of a multi-pass printing mode, and the selected spit pattern is the first spit pattern, the method further comprising:

selecting another spit pattern different from the first spit pattern;

spitting the printing fluid from the plurality of nozzles in the trench according to the another spit pattern while the plurality of nozzles are off to one side of the media before printing another pass of the user image in the multi-pass printing mode.

14. The method of claim 10, wherein the spitting of the printing fluid from the plurality of nozzles is performed during the pre-conditioning operation that is separate from any printing operation that prints a pass of the user image.

15. The method of claim 10, wherein the selected spit pattern has a same number of entries as a number of the plurality of nozzles in the trench.

16. A non-transitory computer readable medium containing computer executable instructions, that when executed cause a system to:

during pre-conditioning of a printhead:

select a spit pattern from among different spit patterns stored in a memory dependent upon a type of printing fluid used to form a user image, the selected spit pattern being a first spit pattern of the different spit patterns responsive to a first type of the printing fluid being used to form the user image, and the selected spit pattern being a different second spit pattern of the different spit patterns responsive to a different second type of the printing fluid being used to form the user image, wherein each respective spit pattern of the different spit patterns is non-uniform along a length of the respective spit pattern; and cause spitting of the printing fluid from a plurality of nozzles in a trench of the printhead according to the selected spit pattern loaded from the memory while the plurality of nozzles are off to one side of a media before printing a pass of the user image onto the media, wherein the selected spit pattern is separate from the user image; and after the pre-conditioning of the printhead, cause printing of the pass of the user image onto the media when the plurality of nozzles of the printhead are over the media.

17. The non-transitory computer readable medium of claim 16, wherein the spitting of the printing fluid from the plurality of nozzles is performed during the pre-conditioning operation that is separate from any printing operation that prints a pass of the user image.

18. The non-transitory computer readable medium of claim 16, wherein the selected spit pattern has a same number of entries as a number of the plurality of nozzles in the trench.

* * * * *